United States Patent [19]

Nakanishi

[11] Patent Number: 4,747,493

[45] Date of Patent: May 31, 1988

[54] CASH DISPENSER

[75] Inventor: Tomoyuki Nakanishi, Moriyama, Japan

[73] Assignee: Omron Tateisi Electronics Co., Ltd., Kyoto, Japan

[21] Appl. No.: 771,661

[22] Filed: Sep. 3, 1985

[30] Foreign Application Priority Data

Sep. 3, 1984 [JP] Japan ..... 59-134319[U]

[51] Int. Cl.[4] ..... B07C 5/34

[52] U.S. Cl. ..... 209/534; 235/379; 271/3.1; 271/225; 271/273; 271/902; 414/43

[58] Field of Search ..... 209/534; 221/7, 12, 221/21; 235/379; 271/184, 225, 273, 274, 902, 3.1, 9; 414/43

[56] References Cited

U.S. PATENT DOCUMENTS

| | | | |
|---|---|---|---|
| 4,066,253 | 1/1978 | Lundbald et al. | 271/9 X |
| 4,159,782 | 7/1979 | Swartzendruber | 221/21 X |
| 4,320,854 | 3/1982 | Hirose | 221/21 X |
| 4,397,455 | 8/1983 | Hickey | 271/3.1 |
| 4,434,359 | 2/1984 | Watanabe | 271/9 X |
| 4,462,509 | 7/1984 | Adelberger | 271/3.1 X |
| 4,465,925 | 8/1984 | Goi . | |
| 4,482,057 | 11/1984 | Shawen et al. | 209/534 |

FOREIGN PATENT DOCUMENTS

| | | | |
|---|---|---|---|
| 0100962 | 2/1984 | European Pat. Off. . | |
| 0109743 | 5/1984 | European Pat. Off. . | |
| 3222689 | 12/1982 | Fed. Rep. of Germany . | |
| 2094531 | 9/1982 | United Kingdom . | |
| 2111951 | 7/1983 | United Kingdom | 414/43 |

OTHER PUBLICATIONS

Patent Abstracts of Japan, unexamined appl., E Sec., vol. 2, No. 101, Aug. 19, 1978 The Patent Office Japanese Government p. 5171 E 78, Kokai-No. 56-66, 797, (Tateishi Denki K.K.).

Patent Abstracts of Japan, unexamined appl., E Sec., vol. 2, No. 45, Mar. 27, 1978, The Patent Office Japanese Government p. 547 E 78, Kokai-No. 53-9, 198 (Tokyo Shibaura Denki K.K.).

*Primary Examiner*—Johnny D. Cherry
*Assistant Examiner*—Edward M. Wacyra
*Attorney, Agent, or Firm*—Stevens, Davis, Miller & Mosher

[57] ABSTRACT

A cash dispenser is provided with cash containers for storing bills classified according to the kinds of money, a reject container for collecting unacceptable bills and acceptable bills cancelled by the customer, and a bill discharge outlet, etc. Acceptable bills sent from cash containers are collected temporarily at temporal bill collection station (ESCROW), while unacceptable bills are directly carried into the reject container one by one through first collection path whenever detected. The bills stacked at the collection station are delivered in a lump through bill discharge path to the bill discharge outlet in response to a cash discharge command, but are collected in a lump into the reject container through second collection path in response to a cash collection command.

4 Claims, 3 Drawing Sheets

CASH DISPENSER

BACKGROUND OF THE INVENTION

1. Field of the Invention

The present invention relates to a cash dispenser incorporated in various cash handling apparatuses such as an automated cash depositing and dispensing machine, automated teller machine (ATM), automated cash dispensing machine, etc., which are equipped in banks, financiers or stores for executing deposit and payment or withdrawal transactions.

2. Description of the Prior Art

In automated depositing machines such as above-mentioned ATM, there is provided a temporary bill collection station (ESCROW) in which bills inserted into the machine for deposit are stored temporarily until the deposit transaction has been completed. This is because all the inserted bills should be returned to the customer in case the customer cancels the current deposit transaction after he has inserted bills into the machine, or the machine is out of order for some reason or other during deposit transaction.

The above-mentioned temporary bill collection station has recently been provided even in cash dispensers. An example of these cash dispensers is disclosed in U.S. Pat. No. 4,397,455 by Richard C. Hickey. The reason why such a temporary bill collection station is necessary is as follows: In case some troubles or malfunctions occur in bill carrier paths for carrying bills from cash containers to a cash discharge outlet or other sections, it is required to collect bills already carried from the cash containers before discharging the bills for the customer through the discharge outlet slot. Further, it is necessary to discharge bills for the customer after the amount and the kind of money specified by the customer have been confirmed. The assumption is made that in discharging ten bills for instance, a trouble occurs while the seventh bill are being carried within the machine after six bills have already been discharged for the customer. In this case, the way to handle the already-discharged six bills is difficult and complicated. Since the customer demands ten bills, the six bills are not sufficient. However, it is impossible to continue the payment transaction before the trouble is perfectly removed.

Therefore, the above-mentioned trouble or disadvantages can be eliminated when the specified bills are once stacked at the temporary bill collection station and then discharged in a lump for the customer after the accumulation or collection of specified amount and kind of money has been confirmed. Even if some trouble occurs while bills are being carried to the temporary bill collection station, there exists no special problems because bills are not yet discharged to the customer.

By the way, while bills are being carried from the cash containers to the temporary bill collection station, various bill inspections are required in many cases. There inspections are to check whether two or more bills are superposed, or whether the specified kinds of money are carried or whether the carried bills are appropriate for customer in quality (no damage is present), etc.

In the prior-art bill dispenser as described above, however, there exist shortcomings shch that when some unacceptable bills are detected, the cash payment transaction takes much time, thus reducing the efficiency in cash handling time and cash availability. The basic problems are: although a temporary bill collection station classified according to the kind of bills is provided between a cash container and a bill discharge outlet, in the case where an unacceptable bill is detected during the above bill inspection processes after some acceptable bills have already been stacked at the temporary bill collection station, it is necessary to move all the already-stacked acceptable bills once into the reject container together with this single unacceptable bill. Thereafter, the same operation of stacking bills at the collection station should be repeated while returning to the start.

SUMMARY OF THE INVENTION

With these problems in mind, therefore, it is the primary object of the present invention to provide a cash dispenser of high efficiency type in cash handling time and cash availability.

To achieve the above-mentioned object, the cash dispenser for dispensing bills stored in cash containers classified according to the kind of bills through a cash discharge outlet in accordance with customer's or operator's demand according to the present invention comprises: (a) means for temporarily collecting bills sent from the cash containers; (b) means for collecting rejected bills; (c) first means for carrying unacceptable bills sent from the cash containers into the rejected bill collecting means whenever an unacceptable bill is detected, (d) second means for carrying a stack of bills in the bill temporarily collecting means in a lump into the rejected bill collecting means in response to a cash collection command, and (e) third means for carrying a stack of acceptable bills in the bill temporarily collecting means in a lump to the cash discharge outlet in response to a cash discharge command.

In the cash dispenser according to the present invention, since first means is additionally provided for directly carrying unacceptable bills sent from the cash containers into the rejected bill collecting means whenever an unacceptable bill is detected, only acceptable bills are collected at the temporarily bill collecting means, thus improving the efficiency in cash handling time and cash availability. In this connection, in the prior-art cash dispenser, since unacceptable bills are also collected at the temporarily bill collecting means together with acceptable bills, it is necessary to reject all the bills including only a single unacceptable bill from the temporarily bill collecting means to the rejected bill collecting means.

In the cash dispenser according to the present invention, since temporarily bill collecting means is provided for stacking up the specified number and the specified kind of acceptable bills, there stacked specified bills can be dispensed in a lump to the bill discharge outlet through the third bill carrying means in response to a cash discharge command or collected in a lump into the rejected bill collecting means through the second bill carrying means in response to a cash collection command produced based on, for example, customer's cancellation of payment transaction and so on.

BRIEF DESCRIPTION OF THE DRAWINGS

The features and advantages of the cash dispenser according to the present invention will be more clearly appreciated from the following description taken in conjunction with the accompanying drawings in which.

DETAILED DESCRIPTION OF THE EMBODIMENT

To facilitate understanding the present invention, a brief reference will be made to a typical construction of a cash dispenser. Within a cash dispenser, there are arranged a plurality of cash storage containers as classified according to the kind of paper currency or bills. In cash payment or withdrawal transactions, whenever a customer specifies the number of bills and the kind of bills, the specified number and specified kind of bills are carried one by one in sequence from the cash containers. The carried bills are all inspected one by one on the basis of various inspection items such as bill superposition check (whether two or more bills are superposed or not), bill identification check (whether bills matches with the specified kind or not), or bill condition check (whether the bill is damaged or not), etc. The bill superposition is inspected by a bill superposition senser of well-known mechanical or optical type; the bill identification and bill condition are inspected by a bill checker of well-known optical or magnetic type.

Figure 1:
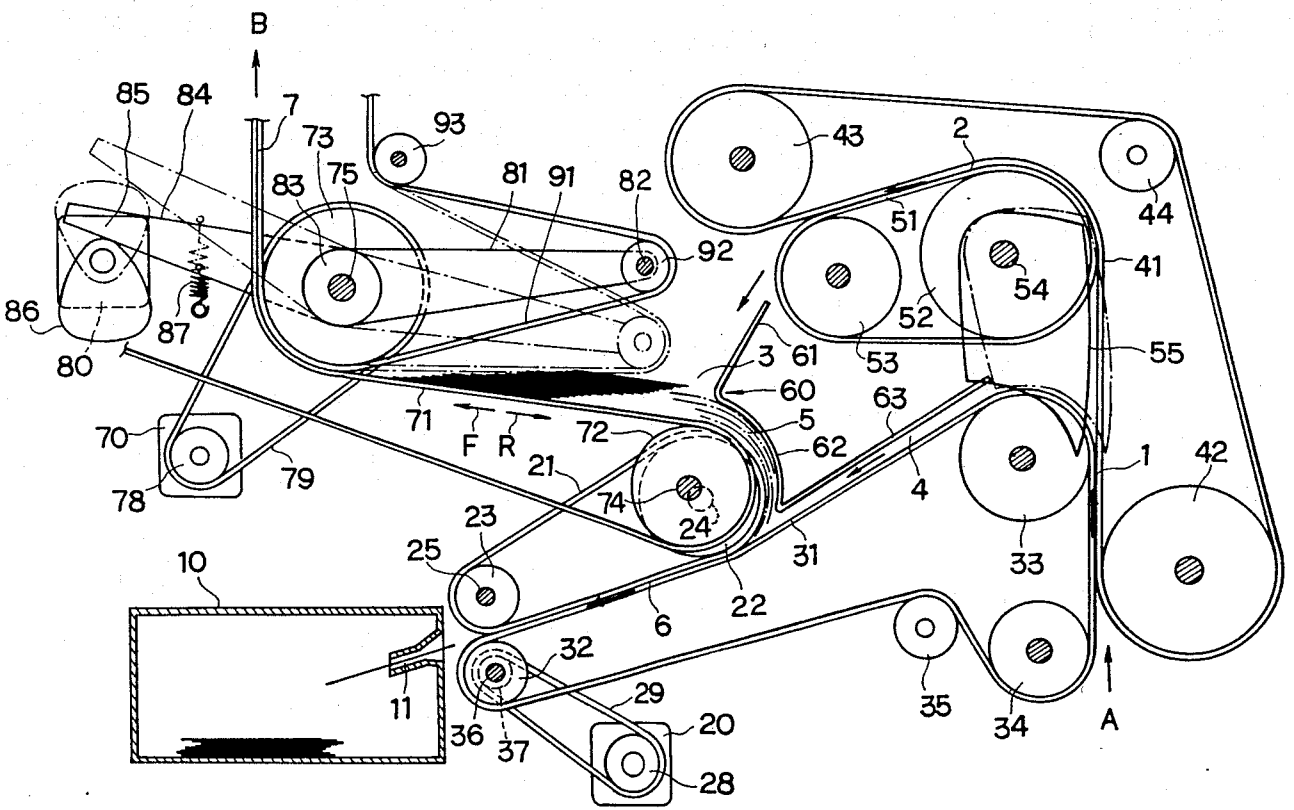
FIG. 1 is a diagrammatical side view, partially in cross section showing an embodiment of the cash dispenser according to the present invention.

With reference to FIG. 1, an inspected bill or bills (if superposed) are carried from a cash container (not shown) to a first carrier path 1 as shown by arrow A. The carried bills are discharged through a discharge path 7 as shown by arrow B for executing a payment transaction required by a customer or collected into a bill reject (collecting) container 10 when the carried bills are cancelled by the customer before discharge.

Prior to a detailed description of the rather complicated construction of the bill collection device according to the present invention, the function of the device will roughly be explained hereinbelow for assistance in understanding the construction thereof. The device is provided with a first carrier path 1 for carrying the inspected bills, a second carrier path 2 for carrying mainly the acceptable bills after the above inspections have been completed, a temporary bill collection station 3 (so-called ESCROW), for temporarily storing mainly the acceptable bills, a first collection path 4 for directly carrying the unacceptable bills into the bill reject container 10 while the above inspections are being implemented, a second collection path 5 for carrying mainly the cancelled bills into the bill reject container 10 after the bills are once temporarily stacked at the temporary collection station 3, a third collection path 6 for carrying unacceptable bills carried through the first collection path 4 and the bills carried through the second collection path 5, and a bill discharge path 7.

Therefore, the inspected bills are all passed one by one through the first carrier path 1. The acceptable bills are sent one by one to the collection station 3 through the second carrier path 2, but the unacceptable bills are directly sent one by one into the reject container 10 through the first and third collection paths 4 and 6. The acceptable bills temporarily collected at the station 3 are discharged in a lump through the discharge path 7 in response to a cash discharge command but collected into the reject container 10 in a lump through the second and third collection paths 5 and 6 in response to cash collection command.

By the way, bills are generally rectangular in shape, having two long sides in the longitudinal direction and two short sides in the lateral direction thereof. In the device shown in FIG. 1, bill are passed or carried through the various paths with the two short sides arranged in parallel with the longitudinal direction of the paths.

The reject container 10 is formed with a bill inlet slot 11 long in width but short in height. The width of the slot 11 should be larger than the longitudinal length of the largest bill to be handled so as to receive all the bills carried through carrier and collection paths. Here, it is preferable to reduce the size or dimensions (especially in height) of the bill inlet slot 11 as small as possible under the consideration of crime prevention. This is because it is impossible to illegally extract some bills collected into the reject container 10 by, for example, inserting the hand or finger thereinto through the inlet slot 11. Of course, the reject container 10 is provided with a door (not shown) to be locked.

The construction of various carrier paths, collection paths and discharge path will be described hereinbelow in detail, which are all made up of pulleys, belts reeved or threaded around the pulleys, and motors for driving the pulleys.

Figure 2:
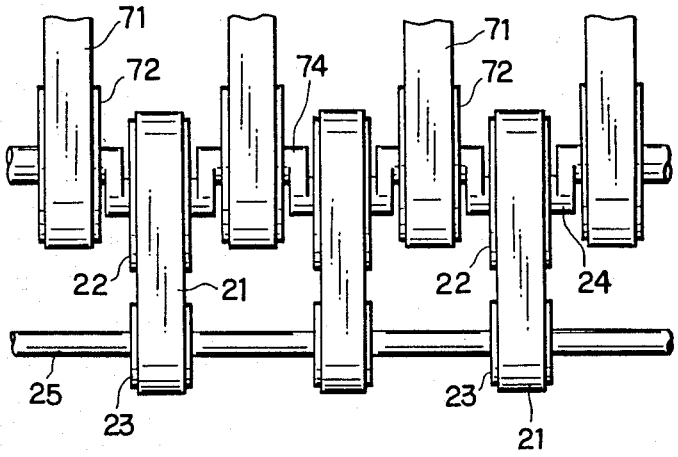
FIG. 2 is a front view showing a second collection path in FIG. 1.

The third collection path 6 is made up of belts 31 and belts 21. The belts 21 are reeved around pulleys 22 rotatably supported by shaft portions 24 and pulleys 23 fixed to a rotatable shaft 25, and are arranged in parallel at an appropriate space interval with each other as shown in FIG. 2. The belts 31 are reeved around pulleys 32 fixed to a rotatable shaft 36, and pulleys 33, 34 and 35 fixed to other rotatable shafts, and are arranged in parallel with a predetermined distance.

The first carrier path 1 is made up of the belts 31 and belts 41. The belts 41 are reeved around pulleys 42, 43 and 44. The inspected bills coming in the direction of arrow A are carried being sandwiched between the belts 31 and 41.

The second carrier path 2 is made up of the belts 41 and belts 51. The belts 51 are reeved around pulleys 52 rotatably supported by a shaft 54 and pulleys 53 fixed to a rotatable shaft.

A switch flapper 55 is pivotably supported by the shaft 54. This flapper 55 is actuated by an appropriate actuator such as a solenoid 56 shown in FIG. 3. Usually, this flapper is located at the position as shown by the solid lines in FIG. 1. In this normal condition, therefore the inspected bill is carried from the first carrier path 1 to the second carrier path 2. In contrast with this, where an inpsected bill is determined to be unacceptable, the switch flapper 55 is pivoted to a position as shown by the dot-dot-dashed lines. In this abnormal condition, therefore the inspected bill is directly carried from the first carrier path 1 to the reject container 10 by way of the first collection path 4 and the third collection path 6.

The first collection path 4 is made up of the belts 31 and a straight guide plate 63. This guide plate 63 is a part of a limit member 60 described later in further detail.

A first motor 20 drives the first carrier path 1, the second carrier path 2, the first collection path 4 and the third collection path 6 simultaneously at a very high speed. A pulley 28 is fixed to a drive shaft of this motor 20. A belt 29 is reeved around the pulley 28 and a pulley 37 fixed to a rotatable shaft 36 toghther with the already-described pulleys 32. Therefore, when the first motor 20 rotates, the pulleys 32 are rotated by the drive belt 29 to drive the belts 31 in the direction of the arrow. Since the belts 41 and 21 are in pressure contact with the belts 31 and additionally the belts 51 are also in pressure contact with the belts 41, all there belts are driven simultaneously as the belts 31 are being driven. However, it is also possible to drive these belts 21, 41 and 51 simultaneously by the aid of an appropriate power transmission mechanism (not shown) actuated by the first motor 20. Further, in order to further ensure the simultaneous driving operation, it is preferable to bring the pulleys 23 into pressure contact with the pulleys 32, the pulleys 42 into pressure contact with the pulleys 34, and the pulleys 53 into pressure contact with the pulleys 43, respectively.

The temporary bill collection station (ESCROW) 3 is provided on belts 71 reeved around pulleys 72 rotatably supported by shaft portions 74, pulleys 73 fixed to a rotable shaft 75 and other pulleys (not shown).

As shown in FIG. 2, the shaft portions 24 and 74 are disposed in parallel with and spaced a small distance from each other. A fixed shaft is constructed with the shaft portions 24 and 74 connected alternately with each other by means of connecting members. Therefore the pulleys 22 and 72, which are rotatably supported by the shaft portions 24 and 74, respectively, are positioned eccentrically from each other in the bill collection direction of the second collection path 5.

A belt 79 is reeved around a pulley 78 and one of the pulleys 73 fixed to the rotatable shaft 75. Arms 81 are pivotably supported by the rotatable shaft 75 at the base portions 83 thereof and are connected fixedly to each other. Pulleys 92 are rotatably supported by shafts 82 fixed to one ends of the arms 81. Belts 91 are reeved around the pulleys 92, pulleys 73, another pulleys 93, and the other pulleys (not shown).

A second motor 70 drives the temporary bill collection station 3, the second collection path 5 and the discharge path 7. The pulley 78 is fixed to a drive shaft of this motor 70. Therefore, when the second motor 70 rotates, the belt 79 is driven to rotate the pulleys 73. Since the belts 71 and 91 are reeved together around the pulleys 73 in partially superposed relationship to each other, these two kinds of belts 71 and 91 are both driven. In this embodiment, whenever the second motor 70 rotates in the forward direction, the belts 71 are driven in the bill discharge direction as shown by arrow F; however, whenever rotating in the reverse direction, the belts 71 are driven in the bill collection direction as shown by arrow R in FIG. 1.

To one of the bases 83 of the arms 81, a lever 84 is fixed exending in the roughly opposite direction of the arms 81, and the end portion 85 of the lever 84 is in contact with a cam 86. This cam 86 is directly or via an appropriate transmission mechanism or reduction gear attached to a drive shaft of a third motor 80. The lever 84 is always urged counterclockwise so as to be brought into contact with the cam 86 by a tension spring 87. In the normal conditions where bills are being collected temporarily at the temporary collection station 3, the arms 81 are held in upward position as depicted by the solid lines with the lever end 85 in contact with the cam 86. On the other hand, in the bill collection operation where bills stacked at the temporary collection station 3 are required to be collected in a lump to the reject container 10, the motor 80 is rotated by a half revolution, that is, the cam 86 rotates through 180 degrees to lift the lever end 85 against the elastic force of the spring 87, so that the arms 81 are held in downward position as depicted by the dot-dot-dashed lines. In this position, the pulleys 92 and parts of the belts 91 extending between pulleys 73 and 92 are both moved toward the belts 71 to reduce the space within the temporary collection station 3.

The second collection path 5 is formed by parts of the belts 71 around the pulleys 72, parts of the belts 21 around the pulleys 22, and a circular arc shaped guide portion 62 of a limit member 60 (described later). The space or width (between the pulleys 22, 72 and the guide portion 62) of this second collection path 5 is gradually narrowed radially inwardly in the bill collection direction. The width is approximately 4 mm at its maximum and 2 mm at its minimum, for instance.

The limit member 60 includes three integrally formed guide portions 61, 62 and 63. The first straight guide portion 61 extends obliguely toward the pulleys 53 for guiding bills dropped from the second carrier path 2 onto the belts 71 within the temporary collection station 3. The second curved guide portion 62 is located adjacent to the pulleys 72 and 22 so as to form the second collection path 5 for limiting the total amount (or thickness) of bills to be collected from the temporary collection station 3 to the reject container 10 in stacked bill collection operation (i.e. bills stacked at the station 3 are collected into the reject container 10 in a lump in response to a cash collection command). As already described hereinabove, since the size of the bill inlet slot 11 of the reject container 10 is designed to be as small as possible for crime prevention, it is impossible to insert a great number of bills into the reject container 10 in a lump. Therefore, the second guide portion 62 as well as the lower end of the first guide portion 61 of the limit member 60 serve to slip off the bills stacked at the temporary collection station 3 when the bills are being carried in the collection direction, so that the thickness of plural bills is reduced for permitting the bills to be inserted into the reject container 10 through the small bill inlet slot 11. In this embodiment, about 200 sheets (20 mm) of bills can be stacked at its maximum in the collection station 3. However, these bills are collected in a lump into the reject container 10 by reducing the bill thickness to a value corresponding to about 10 to 20 sheets (1 to 2 mm) of bills. Further, the third straight guide portion 63 extends also obliguely along the belts 31 for directly guiding unacceptable bills rejected by the switch flapper 55 to the reject container 10 in a separate bill collection operation (i.e. a bill is collected into the reject container 10 one by one whenever unaccepted).

Figure 3:
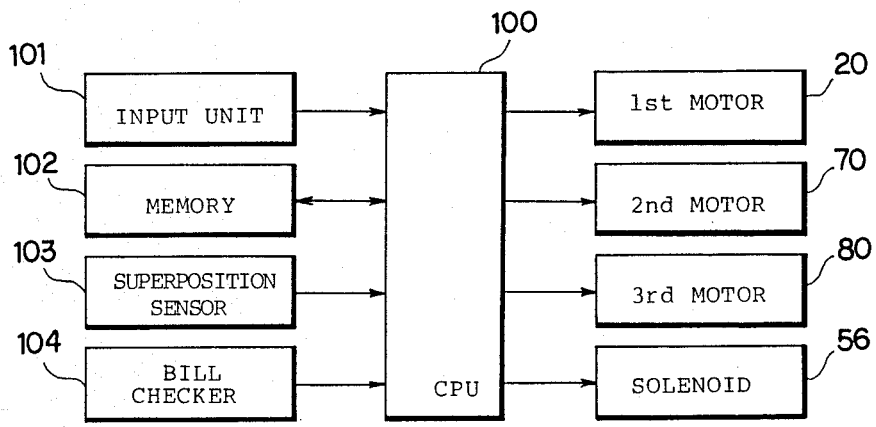
FIG. 3 is a schematic block diagram showing an electronic control system incorporated in the cash dispenser according to the present invention.

FIG. 3 shows an electric or electronic control system configuration of the cash dispenser according to the present invention, being limited only to the essential sections directly related to the embodiment shown in FIGS. 1 and 2. The cash dispenser is controlled by a CPU 100. When a customer inputs various instructions such as the selection of the kind of transactions, cancellation and confirmation, the amount of money to be withdrawn or to be paid, the kind of money, the secret number identifying a customer etc. through keys or buttons arranged in an input unit 101, various signals, corresponding thereto are inputted to the CPU 100. Further, some necessary transaction data are stored in a memory unit 102. Various inspection result signals from a bill superposition senser 103, a bill checker 104, etc. are all inputted to the CPU 100. In response to there input signals and on the basis of the data stored in the memory unit 102, the CPU 100 controls every operation of the first, second and third motors 20, 70 and 80 and a solenoid 56 for actuating the switch flapper 55 in accordance with software incorporated therein.

Figure 4:
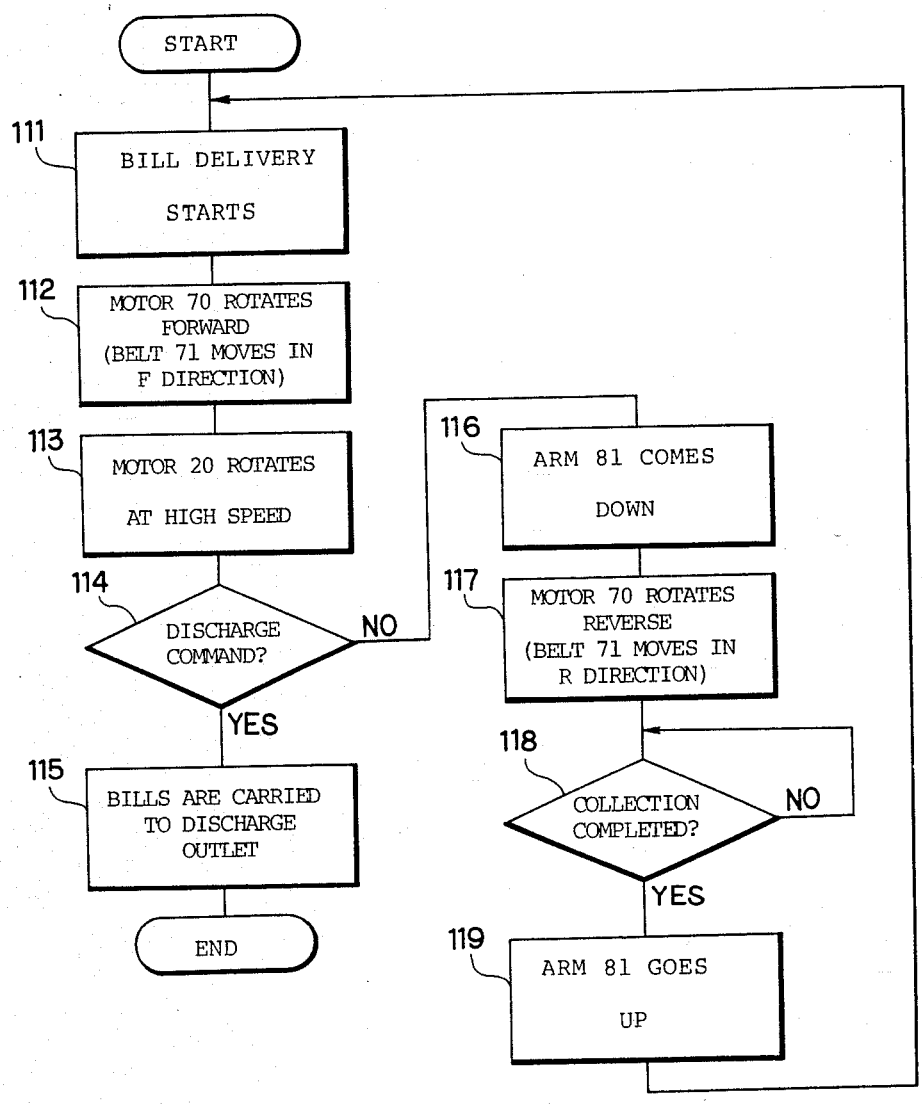
FIG. 4 is an exemplary control flow chart impelemented by the control system for executing bill discharge operation and bill collection operation.

With reference to FIG. 4 additionally, the operation of the cash dispenser shown in FIG. 1 will be described heveinbelow in greater detail. The flowchart shown in FIG. 4 illustrates an example of operations of bill delivery, temporary bill collection, bill discharge and stacked bill collection, and separate bill collection (rejection).

In accordance with the amount of money to be paid and the kind of money both required by a customer or an operator, the number and the kind of bills to be discharged are both determined. In these initial conditions, since the arms 81 are held in upward position as shown by the solid line in FIG. 1 and therefore it is possible to stack the required bills at the temporary bill collection station 3, the operation of bill delivery from a cash container (in practice plural containers are provided as classified according to the kind of bills) starts (in step 111). Accordingly, the second motor 70 starts to rotate in the forward direction, so thta the belt 79 rotates in the same direction; the belts 91 move in the downward direction; and therefore the belts 71 move in the forward direction F at a very slow speed (in step 112). At the same time, the first motor 20 begins to rotate, so that the belt 29, the belts 21, the belts 31, the belts 41 and the belts 51 are all driven simultaneously at a very high speed to deliver bills from a cash container (in step 113).

In the bill delivery process, in the case bill inspection detects that each bills is not superposed, not damaged and the one specified by the command, since the switch flapper 55 is held at the position shown by the solid lines, the inspected and accepted bills are delivered and stacked one by one at the temporary collection station 3 through the first carrier path 1 and the second carrier path 2. The bills stacked at the station 3 are carried toward the bill discharge direction F at a very low speed, because the belts 71 move in the forward direction at a very low speed.

In the bill delivery process, in case bill inspection detects that two or more bills are superposed; each bill is considerably damaged; and a bill not specified by the command is delivered; and therefore these bills are not suitable for discharge, since the switch flapper 55 is moved to the position shown by the dot-dot-dashed lines, the inspected and unacceptable bills are directly rejected one by one into the reject container 10 through the first collection path 4 and the third collecting path 6.

In a short time, the specified amount and the specified kind of bills are stacked on the belts 71 at the temporary collection station 3. Here, it should be noted that since the belts 71 move at a very low speed and the delivery belts 31, 41 and 51 all move at a high speed, the bills have been stacked up before the lowermost bill of a stack of bills reaches the pulleys 73.

When the bill stacking operation is completed, a bill discharge command or a bill collection command is generated.

The discharge command is produced in the CPU 100 ordinarily, for example, in case the customer or operator depresses a confirmation button while watching digits indicative of the amount of money to be paid which are keyed in and indicated on an indicator of the input unit 101.

The collection command is produced in such cases that the customer or operator depresses the cancellation button before the discharge command is generated and that a large number of unacceptable bills are stacked at the temporary collection station 3. The latter case will be described later in detail.

In response to the discharge command (YES for step 114), the bills stacked up at the collection station 3 are discharged in a lump through the discharge path 7 (in step 115). In this step 115, it is preferable to increase the speed of the second motor 70 for quickly discharging the stacked bills.

In response to the collection command (NO for step 114), the bills stacked up at the collection station 3 are collected into the reject container 10 through the second and third collection paths 5 and 6. In more detail, in response to the collection command, the third motor 80 rotates by a half revolution to rotates the cam 86 through 180 degrees, so that the arms 81 come down (in step 116). Therefore, the stacked bills are sandwiched between the belts 71 and the belts 91. Additionally, the second motor 70 begins to rotate in the reverse direction, so that the belt 79 rotates in the same reverse direction; the belts 91 move in the upward direction; and therefore the belts 71 move in the reverse direction R at a relatively high speed lower than that of the belts 21 (in step 117). In these conditions, the bills stacked up at the collection station 3 are delivered into the second collection path 5. When a great number of bills are stacked on the belts 71 and therefore the stacked bills are thick, since the upper bills of the stack are brought into contact with the surface of the limit member 60, the amount of bills carried within the second collection path 5 is automatically restricted. When a predetermined amount (thickness) of bills is carried near the pulleys 22, since the pulleys 22 and the belts 21 rotate at a higher speed than that of the pulleys 72 and the belts 71 and the pulleys 72 and 22 are disposed eccentrically in the collection direction with each other, the lowermost bill(s) is delivered at higher speed in the collection direction and therefore slipped off from the adjoining bill, so that the bill thickness is further reduced. Additionally, since the space or width of the second collection path 5 is reduced in the collection direction, it is possible to further restrict the delivery of upper portion of a stack of bills and therefore to reduce the thickness of the bills. A lump of bills the thickness of which is thus reduced are carried into the reject container 10 through the third collection path 6 and the narrow inlet slot 11.

At the collection station 3, there is disposed a bill existence senser (not shown) of photoelectric type, for instance, for detecting the presence of a bill or bills on the belts 71. When this senser detects the absence of bill and outputs a bill absence signal, since this indicates the completion of stacked bill collection operation (in step 118), the third motor 80 is rotated further by a half revolution to rise the arms 81 in upward position, thus the temporary collection station 3 being restored to the original condition (in step 119).

In the above description, the unacceptable bills such as two or more superposed bills, damaged bills, or the different kind of bills are collected one by one into the reject container 10 through the first collection path 4. However, in case such unacceptable bills are detected continuously beyond a predetermined number or detected frequently during a predetermined time interval, or in case a great number of partially superposed bills are delivered continuously like a bill belt, the CPU 100 outputs a command signal to the solenoid 56 to hold the switch flapper 55 as shown by solid lines in FIG. 1, so that a lump of unacceptable bills are sent to the temporary collection station 3 through the second carrier path 2. This operation continues untill no unacceptable bill is detected. When such a very abnormal situation is improved, the unacceptable bills stacked up at the collection station 3 are immediately collected in a lump into the reject container 10 with the processing of steps 116 to 119, the control being returned to the step 111 for restarting all the steps as described above.

In the embodiment described above, the space or the width of the second collection path 5, that is, the distance between the pulleys 22, 72 and the limit member 60 is narrowed in the bill collection direction. However, it is also possible to realize the same or similar collection operation even if the space or the width is kept constant. Further, it is also possible to rotate the two kinds of pulleys 22 and 72 in concentric parallel relationship with respect to each other. Furthermore, it is also possible to match the speed of the belts 71 with that of the belts 21.

As described above, in the cash dispenser according to the present invention, since first bill collecting path is additionally provided for directly carrying each separate unacceptable bill sent from the cash container into the reject container whenever each unacceptable bill is detected, only acceptable bills are collected and stacked at the temporary collection station, thus it being possible to enhance the efficiency in cash handling time and cash availability.

Further, since the temporary bill collection station is provided for stacking the specified number and the specified kind of acceptable bills, these stacked specified bills can be dispensed in a lump for the customer or operator through the bill discharge path and the bill discharge outlet, but collected in a lump into the reject container through the bill collection path when, for example, the cash payment transaction is cancelled by the customer.

What is claimed is:

1. A cash dispenser for dispensing bills stored in a cash container through a cash discharge outlet, which comprises:

(a) temporary bill collection means for temporarily collecting bills sent from the cash container;

(b) detection means for ascertaining the acceptable/unacceptable condition of a bill;

(c) rejected bill collection means for collecting rejected bills;

(d) first carrying means for carrying unacceptable bills sent from the cash container into said rejected bill collecting means whenever an unacceptable bill is detected by said detection means;

(e) second carrying means for carrying a stack of bills in said temporary bill collecting means in a lump into said rejected bill collecting means, in response to a cash collection command;

(f) third carrying means for carrying a stack of acceptable bills in said temporary bill collecting means in a lump to the cash discharge outlet in response to a cash discharge command; and (g) limiting means disposed near a junction area between said temporary bill collecting means and said second carrying means for limiting the amount of bills being carried in the bill collection direction, wherein said limiting means includes a guide portion and a space of said second bill stack carrying means is reduced gradually in the bill collection direction by means of the guide portion.

2. A cash dispenser for dispensing bills stored in a cash container through a cash discharge outlet, which comprises:

(a) temporary bill collection means for temporarily collecting bills sent from the cash container;

(b) detection means for ascertaining the acceptable/unacceptable condition of a bill;

(c) rejected bill collection means for collecting rejected bills;

(d) first carrying means for carrying unacceptable bills sent from the cash container into said rejected bill collecting means whenever an unacceptable bill is detected by said detection means;

(e) second carrying means for carrying a stack of bills in said temporary bill collecting means in a lump into said rejected bill collecting means, in response to a cash collection command;

(f) third carrying means for carrying a stack of acceptable bills in said temporary bill collecting means in a lump to the cash discharge outlet in response to a cash discharge command; and (g) limiting means disposed near a junction area between said temporary bill collecting means and said second carrying means for limiting the amount of bills being carried in the bill collection direction;

(h) said temporary bill collecting means comprising first pulleys and first belts reeved around said first pulleys on which bills are stacked, said first belts being driven in a forward bill discharge direction in which collected bills are carried to the cash discharge outlet or in a reverse bill collection direction in which collected bills are carried into said rejected bill collecting means;

(i) said second carrying means further comprising second pulleys and second belts reeved around said second pulleys;

(j) said first pulleys and said second pulleys being arranged in eccentric parallel relationship to each other in said second carrying means; and (k) said second belts constituting said second carrying means being driven at a speed higher than that of said first belts constituting said temporary bill collecting means in response to a bill collection command.

3. A cash dispenser for dispensing bills stored in a cash container through a cash discharge outlet, which comprises:

(a) rejected bill collecting means for collecting rejected bills;

(b) temporary bill collecting means for temporarily collecting bills sent from the cash container, said temporary bill collection means comprising first carrier belts on which bills are stacked and which are driven in a forward bill discharge direction or in a reverse bill collection cirction;

(c) first carrying means for carrying a stack of bills in said temporary bill collecting means to the cash discharge outlet in response to a cash discharge command, said first carrying means extending in a first direction;

(d) second carrying means for carrying a stack of bills in said temporary bill collecting means into said rejected bill collecting means in response to a cash collection command, said second carrying means extending in a second direction opposite to said first direction; and (e) limiting means disposed near a junction area between said temporary bill collecting means and said second carrying means for limiting the amount of bills being carried within said second carrying means in the bill collection direction wherein:

(i) said temporary bill collecting means comprises first pulleys around which the first carrier belts are reeved;

(ii) said second carrying means comprises second pulleys and second carrier belts reeved around said second pulleys;

(iii) said first pulleys constituting part of said temporary bill collecting means and said second pulleys constituting part of said second carrying means are arranged in eccentric parallel relationship to each other; and (iv) said second carrier belts are driven at a speed higher than that of said first carrier belts when bills stacked in said temporary bill collecting means are collected.

4. A cash dispenser for dispensing bills stored in cash containers classified according to the kind of bills through a cash discharge outlet, which comprises:

(a) a reject container for collecting rejected bills;

(b) detection means for ascertaining the acceptable/unacceptable condition of a bill;

(c) a collection station for temporarily collecting acceptable bills sent from cash containers, said station being provided with first carrier belts on which cceptable bills are stacked and which are driven in a forward bill discharge direction in which collected stacked bills are carried to the cash discharge outlet or in a reverse bill collection direction in which collected and stacked bills are carried into said reject container;

(d) a first collection path for directly carrying unacceptable bills sent from cash containers into said reject container whenever an unacceptable bill is detected by said detection means, said first path being provided with second belts driven only in a predetermined direction at a speed higher than that of said first carrier belts constituting said collection station; and (e) a second collection path for carrying a stack of acceptable bills on said collection station in a lump into said reject container, said second path being formed by said first carrier belts constituting said collection station extending to a position midway of said first collection path.

* * * * *